US005992886A

United States Patent [19]

Udd

[11] Patent Number: 5,992,886

[45] Date of Patent: Nov. 30, 1999

[54] COVER FOR PRINTED MATTER

[76] Inventor: Sture Udd, Industrigatan 10 K, FIN-65170, Vasa, Finland

[21] Appl. No.: 08/983,042

[22] PCT Filed: Jul. 16, 1996

[86] PCT No.: PCT/FI96/00414

§ 371 Date: Jan. 15, 1998

§ 102(e) Date: Jan. 15, 1998

[87] PCT Pub. No.: WO97/03841

PCT Pub. Date: Feb. 6, 1997

[30] Foreign Application Priority Data

Jul. 20, 1995 [FI] Finland ..... 950341 U

[51] Int. Cl.[6] ..... B42D 3/00

[52] U.S. Cl. ..... 281/29; 281/37

[58] Field of Search ..... 281/15.1, 16, 17, 281/19.1, 20, 22, 28, 29, 36, 37, 640, 51; 402/70, 73

[56] References Cited

U.S. PATENT DOCUMENTS 3,169,029 2/1965 Margolis .
3,231,296 1/1966 Margolis .
4,519,630 5/1985 Holmes .
4,615,541 10/1986 Kwauka .
5,660,514 8/1997 Wilson ..... 281/29

FOREIGN PATENT DOCUMENTS 2 258 273 8/1975 France .
WO89/10846 11/1989 WIPO .
WO95/34430 12/1995 WIPO .

*Primary Examiner*—Willmon Fridie, Jr.
*Attorney, Agent, or Firm*—Burns, Doane, Swecker & Mathis, L.L.P.

[57] ABSTRACT

A cover for a for a book-type article includes a front and a back cover, each of the front and the back cover having an inner and an outer surface, and a spine joining the front and the back cover. The cover also includes flaps extending from outer edges of the front and the back covers and being separated therefrom by groove portions, the flaps being folded along the groove portions substantially parallel to the outer surface of the front and back covers. An outer surface of the flaps is joined to connecting portions of the book-type article such that the inner surface of both the front and the back cover and at least one of an inner surface of the flaps and the connecting portions of the book-type article define an air pocket, the air pocket being closed at outer edges of the front and the back cover and being open toward the spine.

7 Claims, 2 Drawing Sheets

COVER FOR PRINTED MATTER

BACKGROUND AND SUMMARY

The present invention relates to a cover for a printed matter which cover comprises front and back covers with outer surfaces and a spine joining them, the cover being attached to a book block in the printed matter by means of connecting means in the printed matter.

It is known from prior art to make both hard covers and paperback covers for printed matters. Nowadays so-called hard covers are formed by joining together by gluing, for example, different cover manufacturing materials, these materials being glued to each other at their surfaces. Covers manufactured in this way in a separate manufacturing process are attached to the flyleaf or the book block of the printed matter. The cover manufactured in this manner is rigid and hard, but the manufacture of the cover requires a laborious work process in which the different parts of the cover are shaped and attached to one another.

On the other hand, so-called paperback books have flexible paperboard covers. These covers are normally of the same size or smaller than the book block. Covers of this kind cannot, however, keep the printed matter in shape. Also, covers such as these get damaged easily, they get bent and their edges crack, for example.

Prior art further teaches combinations of these which attempt to imitate a hard cover with a flexible paperboard. These kinds of cover assemblies are disclosed in WO 95/34430, U.S. Pat. No. 3,169,029 or U.S. Pat. No. 4,615,541, for example. Covers such as these are, however, complicated in structure and require a rather great amount of material and separate production lines when manufactured.

Finally, prior art teaches different detachable covers that are inserted into a strong false cover in a book or into a cover of a paperback book. These kinds of covers are disclosed in U.S. Pat. No. 4,519,630, for example. This kind of a cover also requires a separate production line and it is difficult to join it into the book or the book block. The detachable cover cannot stay in place properly but the book block tends to fall off from the cover.

The object of the present invention is to form a cover for a printed matter that is simple to manufacture and is flexible, soft and comfortable to handle. A further object of the invention is to form a cover that does not restrict the mutual format of the book block and the cover.

The present invention will obviate the disadvantages mentioned above and provide a cover for a printed matter that can be formed fast and advantageously.

This object is achieved in such a manner that the cover for the printed matter has the characteristics specified in the claims in accordance with the invention. More exactly, this product according to the invention is characterized in that the front and back covers comprise at their outer edges flaps separated by grooves, which flaps, when folded between the connecting means and the front and back covers essentially in the direction of their outer surface and joined together and/or to the connecting means, provide an air pocket in both front and back covers making the assembly of the cover rigid.

The invention is based on the idea that as each book block comprises false covers in both front and back surface of the block, or the flyleaves, they should be utilized more efficiently in the adhesion and forming of the covers. In this way an assembly is attained in which the book cover is formed only by joining together the book block according to the invention and the false covers or the flyleaves, that is, in the following, the so-called connecting means.

Considerable advantages are achieved by means of the invention. Thus by means of it the covers of the printed matter will be made soft, flexible and comfortable to handle by simple solutions in such a manner that the shape of the cover is also in its format independent of the book block.

As the cover block according to the invention is a kind of a semi-manufactured product that will obtain its final shape when arranged in connection with the book block, a considerable amount of material will be saved in manufacturing the cover. Considerable manufacturing costs are preserved by means of saved material and an easier adhesion of the cover block. As the cover block is preferably assembled only by folding, a considerable amount of glue will also be saved. On account of the reduced amount of glue and its uniform structure, the cover according to the invention can also be recycled efficiently without having to be detached and sorted out separately.

The thickness of the cover for the printed matter according to the invention and its appearance can be varied in a simple way by changing the shape or number of the groovings at the edges. This uncomplicated way of changing the thickness of the cover makes it easier to provide various pockets and compartments in the cover. The possibility to vary the thickness of the cover according to the invention also makes it easier to use different ways of surface profiling and surface printing or even surface piercing as an effect on the cover. On account of its assembly, the weight of the cover according to the invention will nonetheless remain at 10 to 50 per cent of the weight of the covers for printed matters at present. This method of manufacturing a lighter book will make transportation cheaper and handling of the book more comfortable.

When using the cover according to invention, the spine of the book is not glued to the spine of the book block as in paperback books, but when gluing is done, the spine between the cover and the false covers will be free, thus making it possible for it to bend freely when the book is opened. In this way, the book will remain open better and the spine of the book block or the spine of the cover will not break in use.

The processing of the cover block can easily be combined to the manufacturing process of the book block, which will prevent the cover from being handled separately. The printing and cutting of the cover and also its make-up and gluing take place preferably at the same time as the printing and the shaping of the book block.

BRIEF DESCRIPTION OF THE DRAWINGS

In the following, the invention will be explained with reference to the appended drawings, in which.

DETAILED DESCRIPTION

Figure 1:
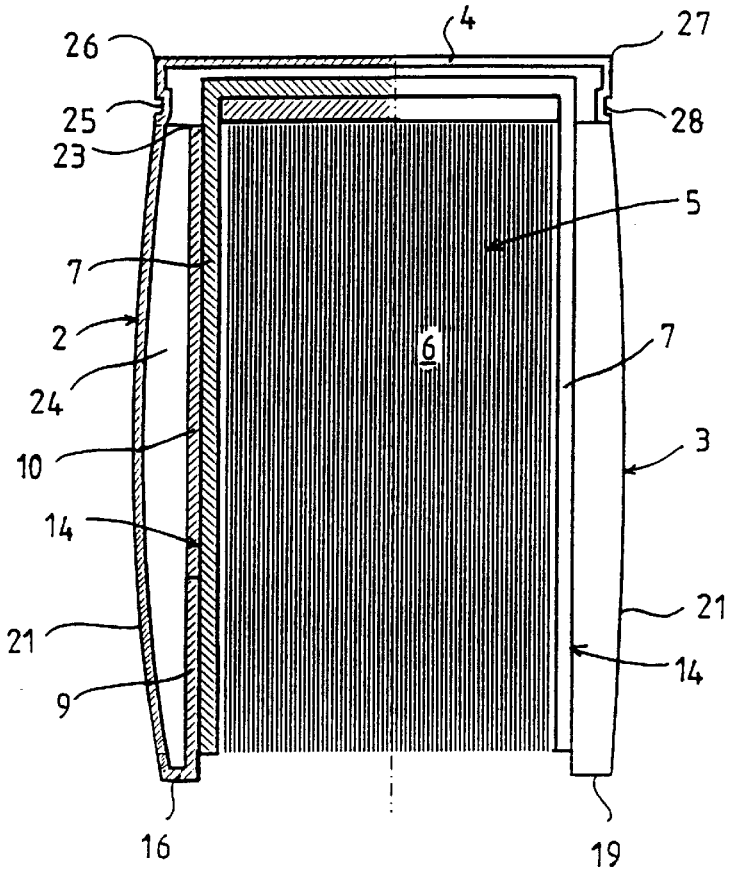
FIG. 1 shows an end view of the printed matter according to the invention in such a manner that the left side of the central axis is shown as a cross-sectional view.
Figure 2:
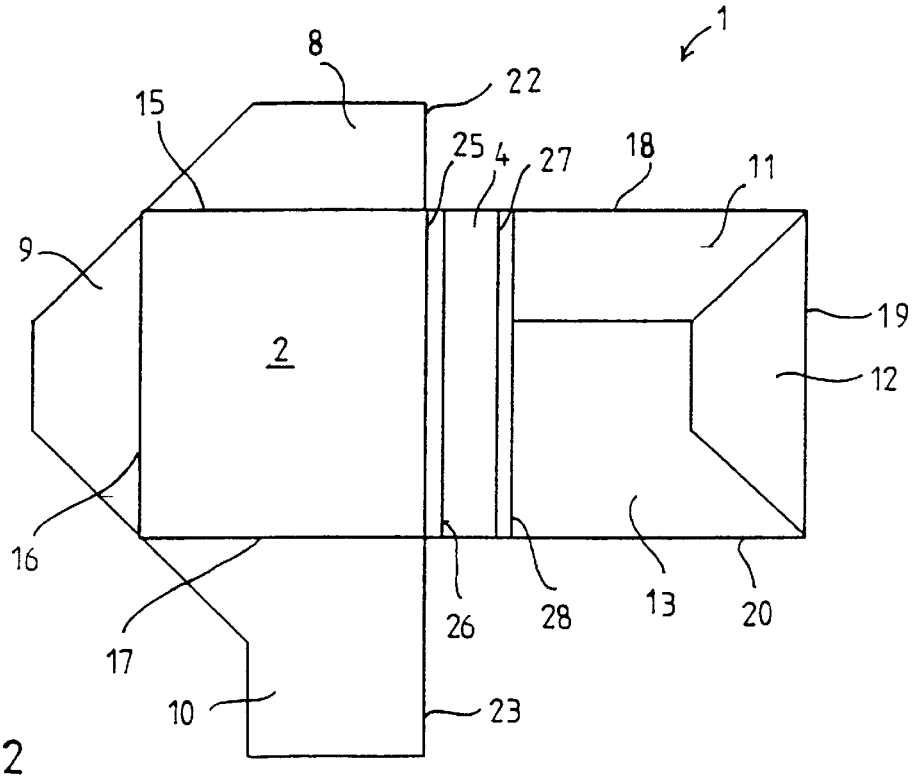
FIG. 2 shows a cover block according to the invention in which the right side of the spine is shown to be folded ready for gluing, and the left side of the spine is shown spread open and grooved.

One preferred embodiment according to the invention shown in FIGS. 1 and 2 comprises a printed matter provided with a cover 1. This cover comprises front and back covers 2 and 3 and a spine 4 joining them together, the cover being arranged at its front and back covers to a book block 5. The book block comprises leaves 6 that are connected to each other by some known method, such as gluing, binding or stapling and connecting means 7, such as flyleaves or false covers. The front and back covers 2 and 3 are attached e.g. to the book block or to the false covers 7 in the book block with methods known per se.

The cover according to the invention is formed by die-cutting the cover block into such a form that it comprises flaps 8 to 13 in addition to the front and back covers 2 and 3 and the spine 4 joining them. The shape of the flaps is chosen to be such that they form an inner surface 14 to the cover when they are folded along grooves 15 to 20 into positions following outer surfaces 21 of the front and back covers in accordance with FIG. 2. When the finished format of the cover is formed, the cover is glued at its inner surface 14 to the book block 5 in the area confined by the edges 22 and 23 of the flaps 8 and 10 on the side of the spine 4 and the free edges of the connecting means, whereby an air pocket 24 is formed in the cover. The die-cutting, grooving, folding and gluing of the cover block can be carried out with ordinary known machines or devices, the operation of which will not be described in more detail herein.

The preferred shape of the flaps 8 to 13 may be other than that shown in the figure, depending on the format and the model of the printed matter and the technical requirements of the gluing device. Therefore the flaps can contact one other at their free edges. They can be placed to overlap at their free edges or they form only a narrow gluing base at the edges of the front and back covers.

Figure 3:
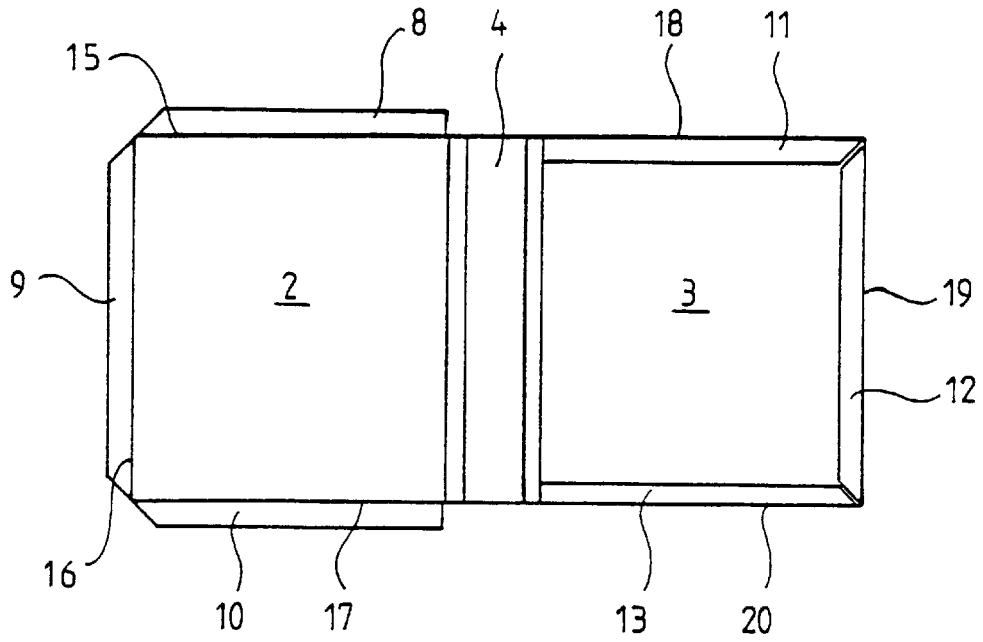
FIG. 3 shows another cover block according to the invention in which the right side of the spine is shown to be folded ready for gluing, and the left side of the spine is shown spread open and grooved, the flaps being narrow.

FIG. 3 thus shows a cover block comprising the front and back covers 2 and 3 combined by the spine 4 as in FIG. 2. In that case the flaps 8 to 13 are separated by groovings 15 to 20 from the front and back covers, the flaps extending only some distance from the outer edge of the front and back covers. When shaping the flaps, they can be arranged to be such that when folding the flaps against the front and back covers, they overlap at the outer corners. Thus it is made possible to attach the flaps to each other by spot-gluing, for example. This is not, however, necessary as the flaps can be shaped to be such that they will not be in contact with each another at any place in accordance with FIG. 3.

The flaps folded against the front and back cover are after this adhered to the connecting means 7 of the book block preferably by gluing.

The embodiment according to FIG. 3 saves as much material as possible with respect to both the paperboard for the cover and the consumption of glue.

The shape of the cover according to the invention can be made for example in the following way. The finished printed and surface-treated cover sheet is die-cut into a preferred shape for the cover block with flaps 8 to 13. The grooves 15 to 20 are made in the block to facilitate the folding of the flaps, whereby folding at least once by means of folding directions and lines defined by the grooves, the flaps 8 to 13 are arranged to form a uniform surface, for example, for gluing the cover to the book block as shown in FIG. 2. In that case the flaps 11, 12 and 13 of the back cover 3, for example, are folded in accordance with FIG. 2 essentially 180 degrees along the grooves 18, 19 and 20, whereby the flaps are placed on the opposite side of the surface-treated outer surface 21, thus forming the inner surface 14 of the cover. The cover is then attached to the book block that has been made with methods known per se, such as sewing or gluing, which will not be explained in more detail herein. Both front and back cover are attached to the book block at its inner surface 14 in the area confined by the edges 22 and 23 of the flaps 8 and 10 and the free edges of the connecting means 7, such as the flyleaf, by gluing or adhering in other way to the book block or another printed matter. When the front and back covers are bound to the book block in this way, the structural layers of their outer and inner surfaces remain apart from one another, thus forming an air pocket 24 in both cover parts 2, 3.

Figure 4:
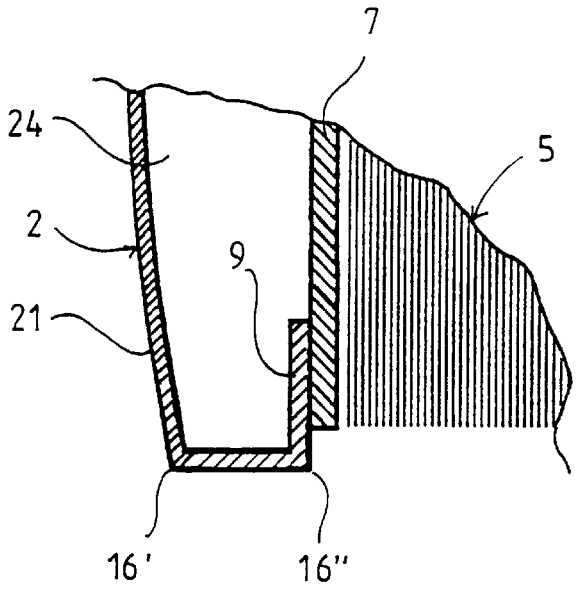
FIG. 4 shows a detail of the outer edge of the cover for the printed matter according to a third embodiment of the invention.

By changing the depth and breadth of the grooves, the air pocket 24 of the cover is formed into a preferable shape depending on the fibre direction and the strength of the material. FIG. 4 shows a detail of one embodiment of the cover in which a thicker air pocket is arranged to the cover by having two parallel grooves 16' and 16" in the cover block instead of the groove 16. By folding the flap first 90 degrees at the groove 16' and a further 90 degrees at the groove 16", an air pocket of desired thickness is produced in the cover.

The tendency of the cover material to straighten and form an air pocket after folding has of course an effect on the preferred shape of the air pocket of the cover. This feature can be guided to a preferred direction as required each time either by strengthening, lowering or otherwise changing the groovings 15 to 20.

The forming of the spine 4 of the printed matter is determined by measuring norms known per se and grooves 25 to 28, which will not be explained in more detail herein.

It is to be understood that the specification above and the figures related thereto are only meant to illustrate the present invention. The invention is therefore not restricted only to the embodiments shown above or specified in the claims, but different variations and modifications of the invention that are possible within the scope of the inventive idea and specified in the appended claims will be evident to those skilled in the art. It is, of course, obvious to those skilled in the art that the invention is not only restricted to the embodiment explained above, but it can vary within the scope of the appended claim.

I claim:

1. A cover for a for a book-type article, the cover comprising:

a front and a back cover, each of the front and the back cover having an inner and an outer surface;

a spine joining the front and the back cover; and flaps extending from outer edges of the front and the back covers and being separated therefrom by groove portions, the flaps being folded along the groove portions substantially parallel to the outer surface of the front and back covers, an outer surface of the flaps being joined to connecting portions of the book-type article such that the inner surface of both the front and the back cover and at least one of an inner surface of the flaps and the connecting portions of the book-type article define an air pocket, the air pocket being closed at outer edges of the front and the back cover and being open toward the spine.

2. A cover according to claim 1, wherein the flaps are connected together when folded.

3. A cover according to claim 1, wherein the connecting portion of the book-type article are endsheet papers of a book block.

4. A cover according to claim 1, wherein the connecting portions of the book-type article are selfends arranged to the book block.

5. A cover according to claim 1, wherein the flaps, when folded between the connecting portions of the book-type article and the front and back covers, form an essentially uniform front surface.

6. A cover according to claim 1, wherein the flaps, when folded between the connecting portions of the book-type article and the front and back covers, form a frame proximate the portions without the flaps being in contact with each another.

7. A cover according to claim 1, wherein the groove portions each include two essentially parallel grooves, a first groove of the grooves being disposed proximate the outer edge and a second groove of the grooves being disposed proximate the flaps, thickness of the air pocket being a function of a distance between the first and the second groove.

* * * * *